US007243508B2

(12) United States Patent
Sanuki et al.

(10) Patent No.: US 7,243,508 B2
(45) Date of Patent: Jul. 17, 2007

(54) ICE MAKING SECTION OF STREAM DOWN TYPE ICE MAKING MACHINE

(75) Inventors: Masao Sanuki, Toyoake (JP); Chiyoshi Toya, Toyoake (JP); Yuji Wakatsuki, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 114 days.

(21) Appl. No.: 11/121,738

(22) Filed: May 3, 2005

(65) Prior Publication Data

US 2005/0252233 A1 Nov. 17, 2005

(30) Foreign Application Priority Data

May 14, 2004 (JP) ..... 2004-145363
May 14, 2004 (JP) ..... 2004-145365
Oct. 5, 2004 (JP) ..... 2004-292798

(51) Int. Cl.
*F25C 1/12* (2006.01)

(52) U.S. Cl. ..... 62/298; 62/347; 29/890.4; 165/76; 165/168

(58) Field of Classification Search ..... 62/347, 62/298, 516–525; 165/76, 168–171; 29/890.039, 29/890.04
See application file for complete search history.

(56) References Cited

U.S. PATENT DOCUMENTS 2,805,557 A 9/1957 Hilger
3,193,659 A * 7/1965 Schaus ..... 219/91.23
3,430,452 A * 3/1969 Dedricks et al. ..... 62/138
4,601,178 A * 7/1986 Suyama et al. ..... 62/347
4,791,792 A * 12/1988 Naruse et al. ..... 62/135
4,804,040 A * 2/1989 Jan-Ove et al. ..... 165/78
4,986,088 A * 1/1991 Nelson ..... 62/347
5,031,417 A * 7/1991 Chang ..... 62/347
5,520,011 A * 5/1996 Hibino ..... 62/347
6,105,385 A * 8/2000 Kato et al. ..... 62/347

FOREIGN PATENT DOCUMENTS

JP 61-165564 7/1986
JP 1-24538 7/1989
JP 2000-146363 5/2000

* cited by examiner

*Primary Examiner*—William E. Tapolcai
(74) *Attorney, Agent, or Firm*—Koda & Androlia

(57) ABSTRACT

An ice making section of a stream down type ice making machine for enabling easy cleaning between a pair of ice making plates and for enabling individual replacement of every component, thereby reducing the cost of replacement.

A plurality of mounting members 16 are provided on an evaporation pipe 14 in parallel being separated at a predetermined interval in the extending direction of a linear part 14. Each of parts to be engaged 16*b*, 16*b* is formed at an open end of each mounting member 16. At an open end of each ice making member 18 formed into generally U-shaped by bending, each engagement part 22*d* which is engageable with and disengageable from the part to be engaged 16*b* is formed. By assembling the ice making member 18 between the mounting members 16, 16 adjacent to each other so as to engage each engagement part 22*d* with the corresponding part to be engaged 16*b*, a first ice making section is configured so that the pair of ice making plates are oppositely arranged across the evaporation pipe 14.

8 Claims, 15 Drawing Sheets

(a)

(b)

ICE MAKING SECTION OF STREAM DOWN TYPE ICE MAKING MACHINE

TECHNICAL FIELD

The present invention relates to an ice making section of a stream down type ice making machine in which a pair of ice making plates are oppositely arranged across an evaporation pipe composing a refrigerating system.

BACKGROUND ART

The stream down type ice making machine is widely known as an ice making machine for making ice blocks continuously, in which a pair of ice making plates are perpendicularly positioned opposite to each other across an evaporation pipe composing a refrigerating system; an ice block is formed by sprinkling ice making water onto a surface (ice making surface) of each of the ice making plates cooled by circulating a coolant supplied through the evaporation pipe; and the obtained ice block is dropped and released by separation (for example, see Japanese Examined Utility Model Publication No. Hei 01-24538). The ice making section composed of the pair of ice making plates and the evaporation pipe is assembled by joining both ice making plates to the evaporation pipe directly using sealing material such as tin, or by welding the pair of ice making plates facing each other across the evaporation pipe through a supporting plate.

PROBLEMS TO BE SOLVED BY THE INVENTION

During the deicing process, deicing water is supplied between the pair of ice making plates thereby accelerating the melting of the frozen surface between an ice block and the ice making plate. Since long-term use leads to contamination therebetween caused by deposits or impurities contained in deicing water such as calcium and silicon, regular cleaning is desirable. However, since the interval at which the pair of ice making plates face each other is narrow and the ice making section cannot be readily disassembled, there is a problem in that the operation of removing adhering stains by inserting a cleaning tool or the like into the narrow space between the opposing surfaces becomes extremely complicated, thereby leading to a lack of regular cleaning by a user causing insanitation.

Also, if rust or the like is formed in a part of the ice making plate or if either one of the ice making plates is deformed or damaged, since the ice making section cannot be disassembled, the entire ice making section has to be replaced, which is extremely uneconomical. Furthermore, since ice making plates have to be prepared in sizes commensurate with the ice making capacity of individual ice making machines, it is also pointed out that the versatility of the ice making plate is poor as its drawback.

When brazing the ice making plate to the evaporation pipe, not only are complicated operations such as surface treatment required, but also the hazardous liquid used for the treatment results in poor working environment and facilities for disposing of the treatment liquid require more expense. Furthermore, long-term use leads to the peeling off of sealing material by deterioration thereby forming a gap between the ice making plate and the evaporation pipe. As a result, the decrease of heat exchange efficiency makes the ice making process and deicing process longer, which can cause a decrease in daily ice making capacity.

It should be noted that when fixing the pair of ice making plates to each other by welding through the supporting plate, the welding operation is also complicated. The dimension error of the supporting plate, thermal strain generated when welding or the like causes a gap to exist between the ice making plate and the evaporation pipe, which can, as with the above, cause a decrease in daily ice making capacity.

Accordingly, the present invention, in light of the abovementioned problems, is suggested to solve the problems inherent in the foregoing prior art in a favorable manner, and it is an object of the present invention to provide an ice making section of a stream down type ice making machine which can stay clean by enabling easy cleaning between the pair of ice making plates; can reduce the cost of replacement by enabling individual replacement of every component; can enhance versatility; and can suppress a decrease in ice making capacity by configuring so that the ice making plate are in close contact with an evaporation pipe at all times without complicated operations such as brazing and welding.

MEANS FOR SOLVING PROBLEMS

In order to overcome the abovementioned problems and achieve the desired objectives in a favorable manner, an ice making section of a stream down type ice making machine according to the present invention comprises:

a pair of ice making plates and an evaporation pipe laid between the back surfaces of both ice making plates meanderingly, a coolant being circulatingly supplied therethrough, in the ice making section of the stream down type ice making machine for making an ice block by supplying ice making water which streams down onto the surface of each ice making plate which is cooled by supplying a coolant through the evaporation pipe circulatingly, wherein:

the pair of ice making plates are characterized by being assembled so as to be attachable to and detachable from each other through an assembling means so that the back surfaces thereof are in contact with the evaporation pipe.

EFFECT OF THE INVENTION

According to an ice making section of a stream down type ice making machine of the invention of the present application, since a pair of ice making plates are configured so that they can be disassembled, the cleaning between the opposing surfaces of both ice making plates becomes easy by separating the ice making plates from each other, thereby keeping clean therebetween. Also, if rust is formed on either of the ice making plates or either ice making plate is deformed or damaged, it is necessary to replace only such ice making plate, thereby reducing the cost of replacement. Furthermore, since no operation such as brazing and welding is performed when assembling, neither surface treatment, hazardous treatment liquid nor the like is required, thereby improving the working environment and reducing facility cost. It should be noted that the ice making section is also advantageous in that by enabling the ice making section to be disassembled, separation of components becomes easy for disposing or recycling.

According to the ice making section of claim 2, since the ice making plate is composed of a plurality of ice making members, individual replacement of every ice making member is possible, thereby further reducing the cost of replacement when rust is formed on the ice making plate or the ice making plate is deformed or damaged. Moreover, by changing the number of ice making members, an ice making plate commensurate with the ice making capacity of individual ice making machines can be configured, thereby being advantageous in that the ice making section has excellent versatility.

According to the ice making section of claim 3, since the ice making section can be handled by each ice making plate, assembly and disassembly operations become simple.

According to the ice making section of the stream down type ice making machine of claim 4, since the ice making member is mounted on the ice making section through a mounting member provided at an evaporation pipe, complicated operations such as brazing and welding become unnecessary. Also, a gap is not formed between the evaporation pipe and the ice making member due to peeling off of sealing material, thermal strain when welding or the like. Furthermore, since the ice making member is configured so as to be brought into close contact with the evaporation pipe by elasticity of the ice making member, heat can be exchanged between the evaporation pipe and the ice making member efficiently, thereby suppressing a decrease in daily ice making capacity.

According to the ice making section of claim 5, since the back surface of the main body is brought into close contact with the evaporation pipe by the elastic deformation of the side plate formed at both end edges of the main body of the ice making member, heat can be exchanged between the main body and the evaporation pipe efficiently. Also, according to the ice making section of claim 6, since the main body is curvedly formed so as to protrude into the back side thereof, the main body pressed against the evaporation pipe by the elastic deformation of the side plate is further elastically deformed, so that the back surface of the main body is brought into closer contact with the evaporation pipe, thereby reliably preventing a gap from being formed between them.

According to the ice making section of claim 7, since at the upper or lower end of the open end where an engagement part of each side plate of the ice making member is formed, a regulation part incapable of engaging with a part to be engaged of the mounting member is formed, the ice making member can be prevented from being mounted upside down relative to the mounting member. Also, the regulation part functions as a positioning means, thereby mounting the ice making member at a proper position relative to the mounting member at all times.

Also, according to the ice making section of claim 8, since at the lower or upper end of the end edge where a part to be engaged of the mounting member is formed, a regulation part incapable of being engaged with an engagement part of the ice making member is formed, the ice making member can be prevented from being mounted upside down relative to the mounting member. Also, the regulation part functions as the positioning means, thereby mounting the ice making member at a proper position relative to the mounting member at all times.

According to the ice making section of the stream down type ice making machine of claim 9, since the pair of ice making plates are mounted across the evaporation pipe by engaging a piece to be engaged with an engagement piece which are arranged on both ice making plates, complicated operations such as brazing and welding become unnecessary. Also, a gap is not formed between the evaporation pipe and the ice making member due to peeling off of sealing material, thermal strain when welding or the like. Furthermore, since each ice making plate is configured so as to be brought into close contact with the evaporation pipe by elasticity of both engagement pieces, heat can be exchanged between the evaporation pipe and the ice making plate efficiently, thereby suppressing a decrease in daily ice making capacity.

BEST MODE FOR CARRYING OUT THE INVENTION

Next, an ice making section of a stream down type ice making machine according to the present invention is described by way of preferred examples with reference to the accompanying drawings.

An ice making section 10 of a stream down type ice making machine according to the configuration shown in FIG. 1 to FIG. 5, comprises a perpendicularly arranged pair of ice making plates 12, 12 and an evaporation pipe 14 tightly held between the opposing surfaces of both ice making plates 12, 12 (between back surfaces), whose linear part 14*a* composes a refrigerating system meanderingly extending in a transverse direction. The ice making section 10 is configured so as to forcibly cool the ice making plates 12, 12 by circulating a coolant through the evaporation pipe 14 during the ice making process. It should be noted that an ice making water supplying means for supplying ice making water onto the surface (ice making surface) of each ice making plate 12 during the ice making process and a deicing water supplying means for supplying deicing water between the opposing surfaces of both ice making plates 12, 12 during the deicing process are provided at the upper portion of the ice making section 10 (neither shown). Also, hot gas (high temperature coolant) is supplied through the evaporation pipe 14 by switching a valve of the refrigerating system during the deicing process. The ice making plates 12, 12 are made of a material of relatively low thermal conductivity such as stainless plate, the evaporation pipe 14 is made of a material of relatively high thermal conductivity such as steel pipe, but other materials may be employed.

Figure 5:
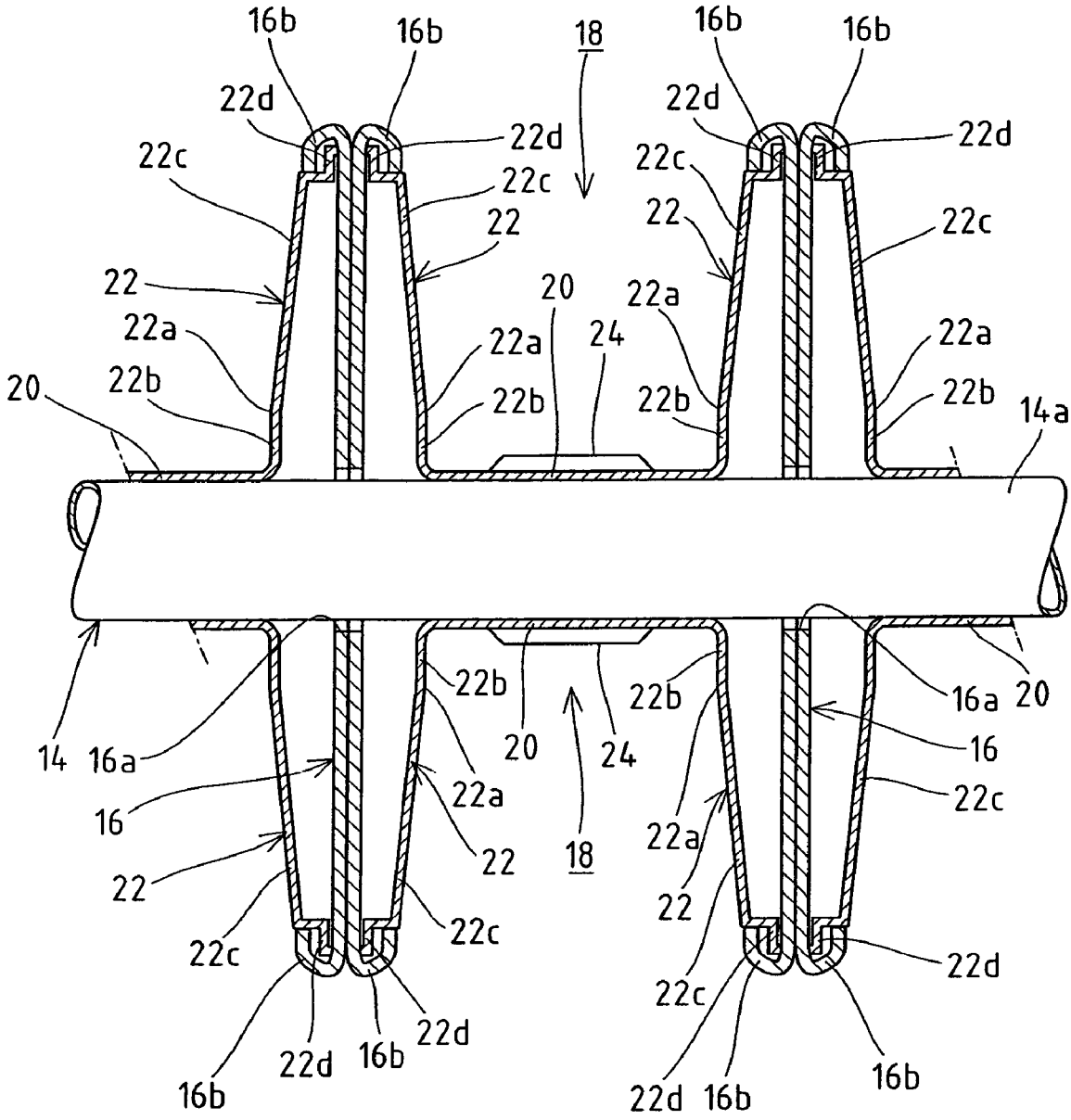
FIG. 5 is a cross sectional plan view showing a substantial part of the ice making section.

On the evaporation pipe 14, a plurality of mounting members 16 are arranged so as to be attachable thereto and detachable therefrom substantially in parallel being separated at a predetermined interval in the extending direction of the linear part 14*a*. The mounting member 16 is a vertically rectangular plate-like stainless steel member, and a plurality of through holes 16*a* for allowing the evaporation pipe 14 to be inserted therethrough are formed being vertically separated at the central position in a direction of the width of the mounting member 16. With the linear parts 14*a* of the evaporation pipe 14 being inserted through the through holes 16*a*, both open ends of the mounting members 16 which vertically extends face outwardly relative to the point orthogonal to the linear parts 14*a*. Also, at both open ends (both end edges) which vertically extend being separated at a predetermined length from the linear part 14*a* of the mounting member 16 toward both sides (sides on which the ice making plates 12 are provided), parts to be engaged 16*b*, 16*b*, which are bent into a hooked shape back to back with each other so as to be open toward the side of the evaporation pipe 14, extending over the entire length of the open end are formed back to back in pairs as shown in FIG. 5. Each ice making member 18 (to be described below) which composes the ice making plate 12 through the parts to be engaged 16*b*, 16*b* is configured so as to be attachable to and detachable from between each pair of mounting members 16, 16 adjacent to each other in the extending direction of the linear part 14*a*.

Figure 1:
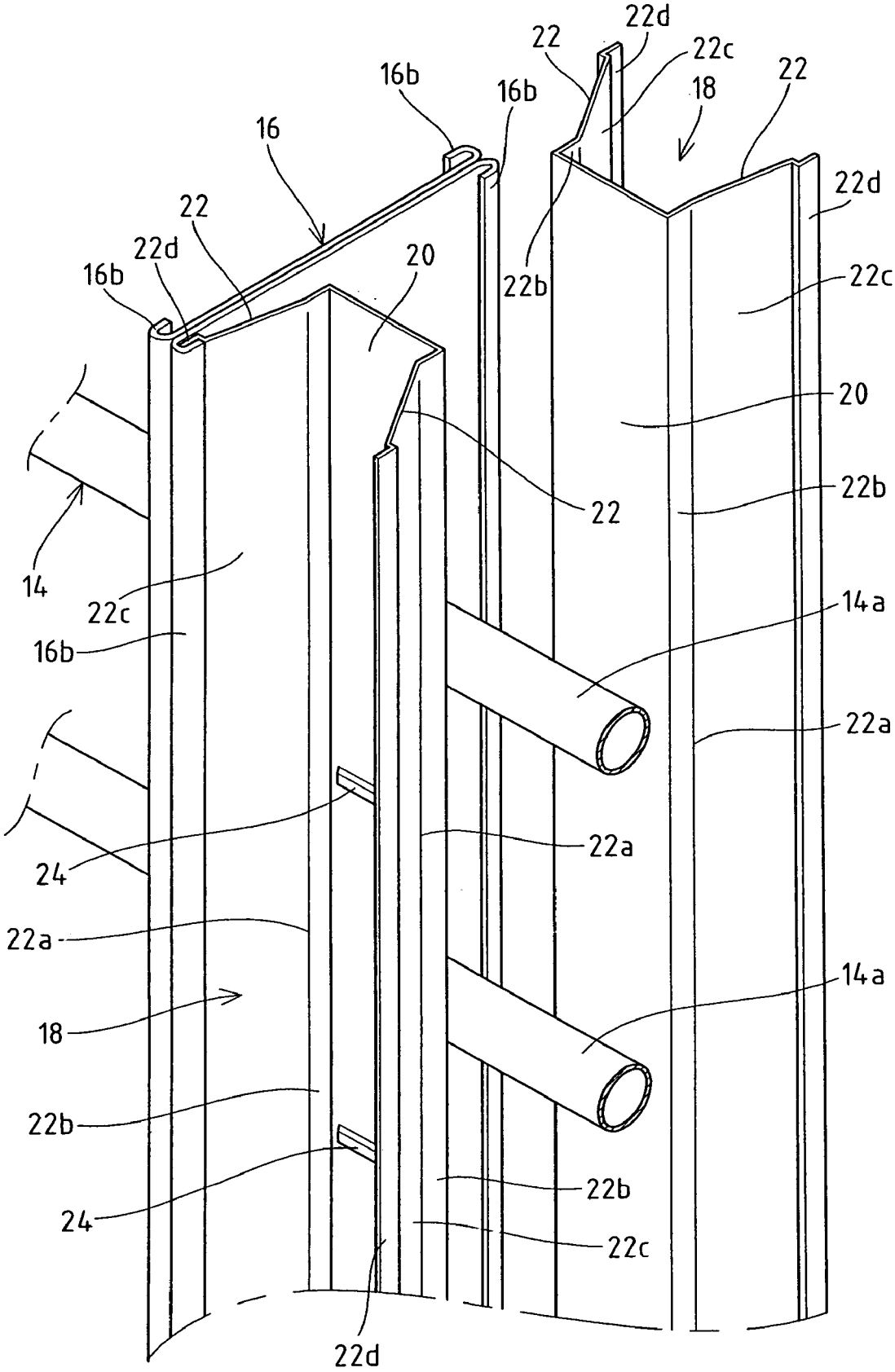
FIG. 1 is an exploded perspective view showing a substantial part of an ice making section of a stream down type ice making machine.
Figure 2:
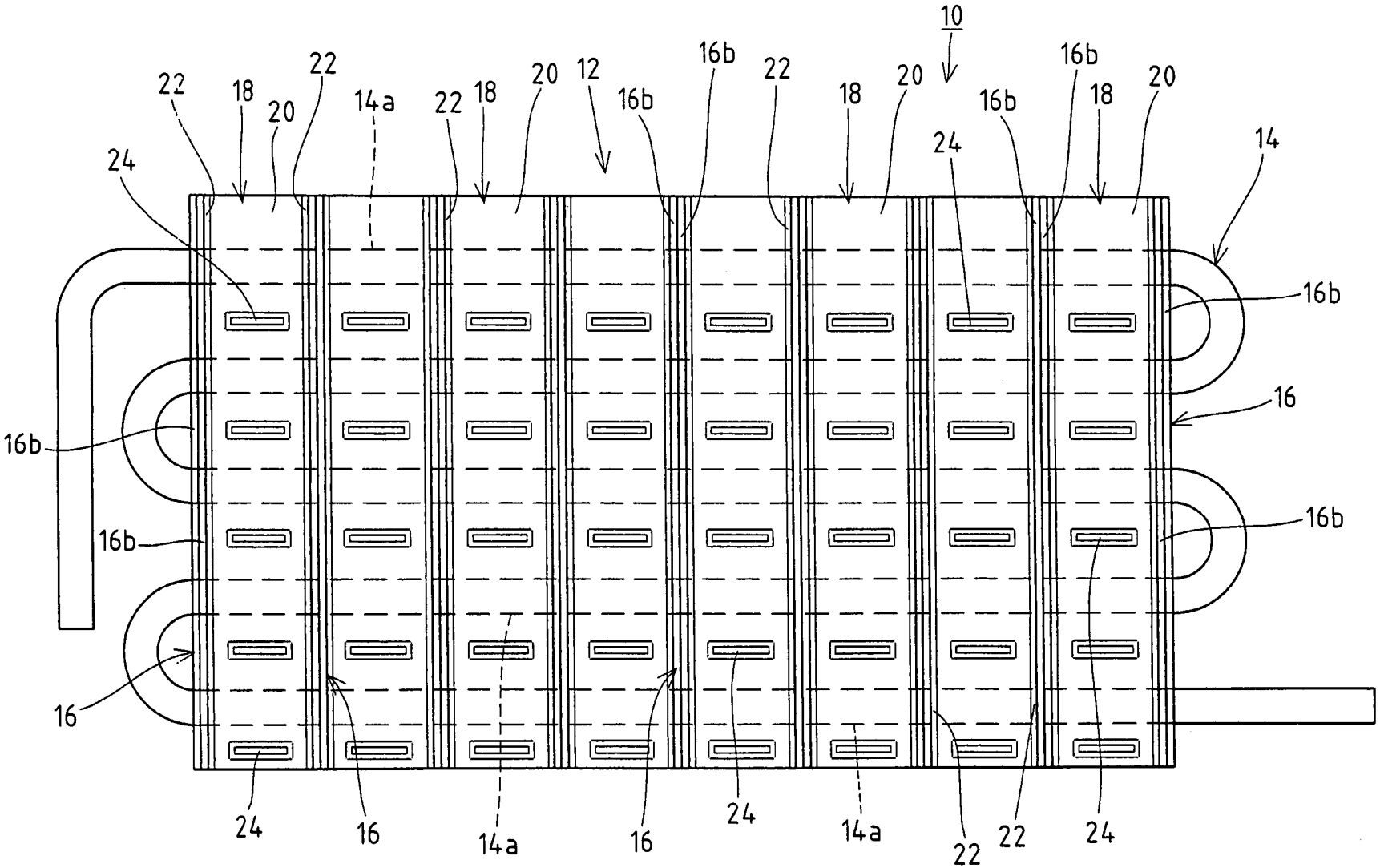
FIG. 2 shows a front view of the ice making section.
Figure 3:
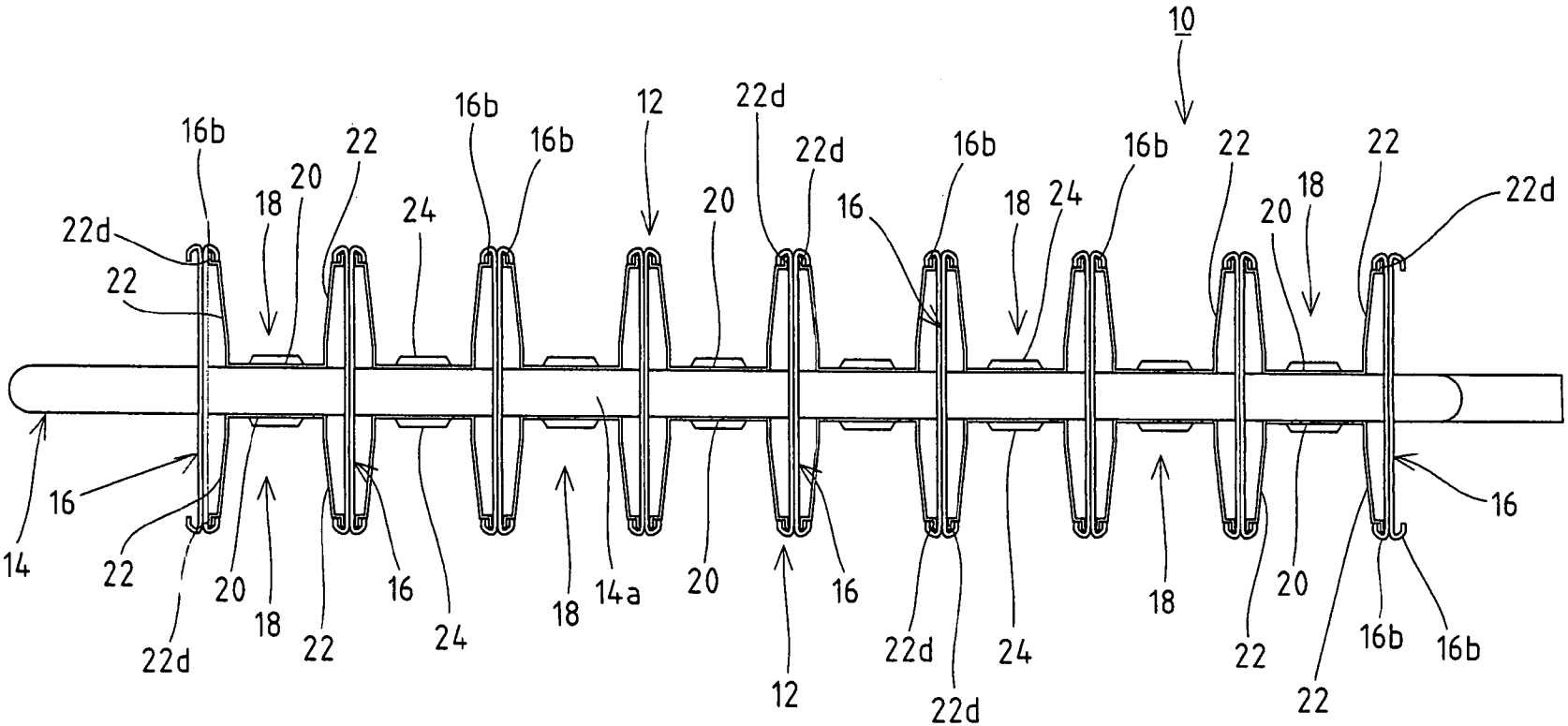
FIG. 3 shows a plan view of the ice making section.
Figure 4:
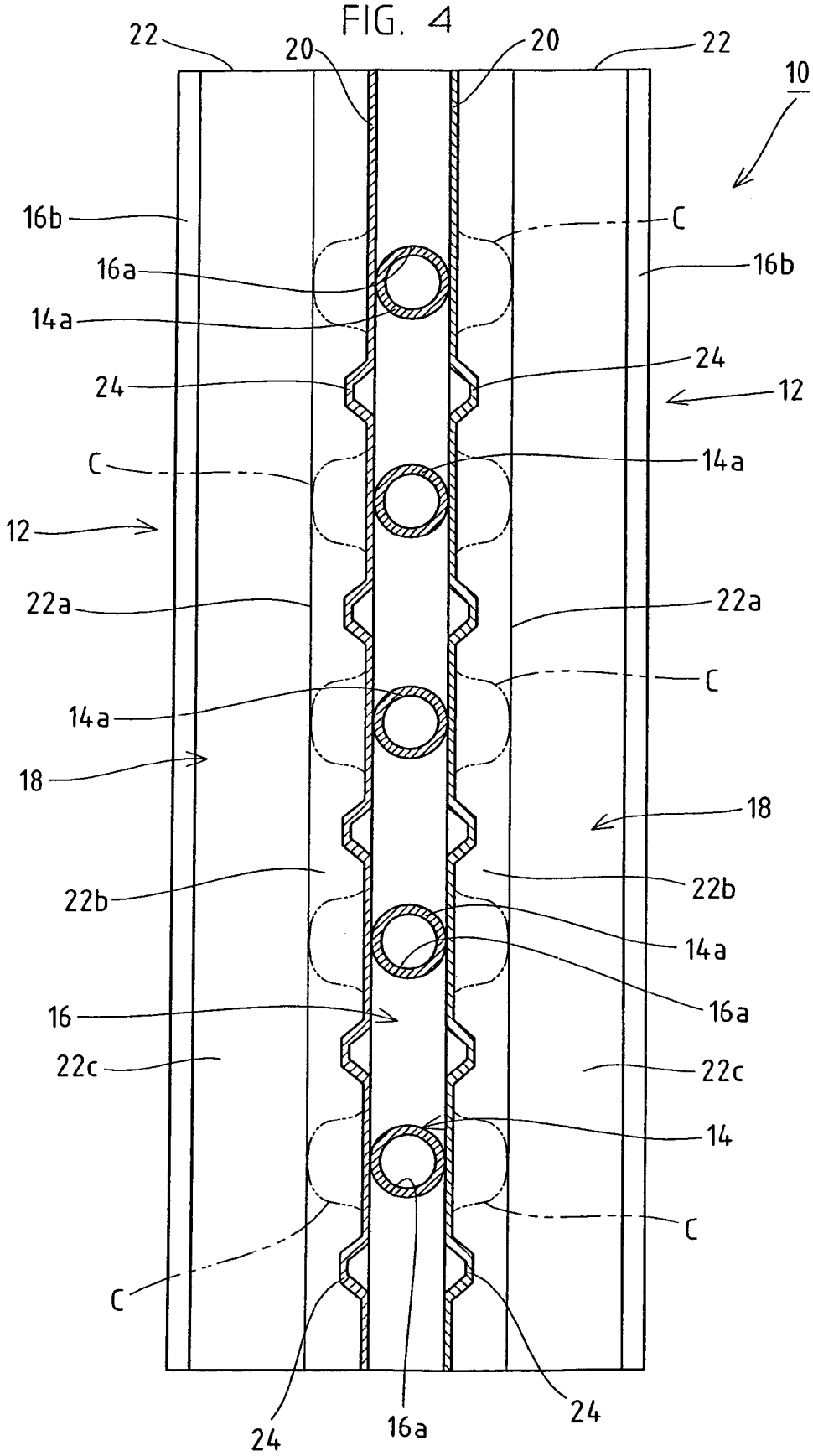
FIG. 4 shows a longitudinal sectional side view of the ice making section.

Each ice making plate 12 composing the ice making section 10 is configured by arranging a plurality of ice making members 18 which are formed by bending a thin stainless steel plate into a predetermined shape along the extending direction of the linear part 14*a* of the evaporation pipe 14 in parallel (see FIG. 2 and FIG. 3). The ice making member 18, as shown in FIG. 4 or FIG. 5, is formed by bending both ends in the width direction of the main body 20, extending vertically and located substantially parallel to the evaporation pipe 14 (both end edges in the extending direction of the linear part 14*a*), into generally U-shape opening outward in a plane cross section in an outward direction away from the evaporation pipe 14 (toward the front side of the main body 20). The inner part surrounded by the main body 20 and the pair of side plates 22, 22 outwardly extending from both end edges of the main body 20 becomes an ice making area, and ice making water is supplied so as to stream down to the ice making area through the ice making water supplying means. A plurality of projections 24 are vertically formed at a predetermined interval on the main body 20, and each projection 24 is set so as to appear between the linear parts 14*a*, 14*a* of the evaporation pipe 14 located above and below. It should be noted that the longitudinal length of the ice making member 18 is set to be approximately the same as the longitudinal length of the mounting member 16.

Each side plate 22 of the ice making member 18 is bent at a predetermined angle in a direction away from the other side plate 22 at a location separate from the main body 20 at a predetermined interval. The side plate 22 comprises a first side 22*b* located on the side of the main body and a second side 22*c* located on the side of the open end across the bend 22*a*. Specifically, at least the second sides 22*c*, 22*c* of the side plates 22, 22 are set so as to spread outward gradually as being separated from the main body 20. By setting the separation distance between the second sides 22*c*, 22*c* to be longer than the separation distance between the first sides 22*b*, 22*b* of both side plates 22, 22, a large clearance is formed between an ice block C in which freeze with the main body 20 has been thawed and the side plates 22, 22 during the deicing process so that the ice block C can be dropped immediately.

At the open end of each side plate 22 extending vertically, a generally L-shaped engagement part 22*d* is formed over the entire length of the open end, being bent in a direction away from the other side plate 22 and then bent outwardly. The engagement part 22*d* is configured so as to engagable with and disengageable from the part to be engaged 16*b* of the mounting member 16. Specifically, each ice making member 18 is assemble mounted between the pair of mounting members 16, 16 adjacent to each other in the extending direction of the linear part 14*a*, by engaging the engagement part 22*d* of each side plate 22 with the part to be engaged 16*b* of the corresponding mounting member 16 from the side of the evaporation pipe 14, with the back surface of the main body 20 in contact with the linear part 14*a* of the evaporation pipe 14 as shown in FIG. 5. In Example 1, an assembling means for assembling both ice making plates 12, 12 so as to be attachable and detachable is thus composed of the part to be engaged 16*b* provided in the mounting member 16 and the engagement part 22*d* provided in the ice making member 18. It should be noted that by forming the engagement part 22*d* into a generally L-shape as mentioned above, large irregularities are prevented from occurring on the surface facing the inside on the open end side of the ice making member 18, when the engagement part 22*d* is engaged with the part to be engaged 16*b*.

Also, in the pair of ice making members 18, 18 mounted on the pair of mounting members 16, 16, with the back surfaces of the main bodies 20, 20 being opposed to each other, the separation distance between the back surfaces of the main bodies 20, 20 is set to be shorter than the diameter in the corresponding direction of the evaporation pipe 14 in a no-load condition. Each ice making member 18 is pressed by its own elasticity so that the back surface of the main body 20 is brought into close contact with the evaporation pipe 14, with the evaporation pipe 14 being inserted between the two ice making members 18, 18. Specifically, the separation distance from the surface of the evaporation pipe 14 up to the part to be engaged 16*b* of the mounting member 16 is set to be shorter than the separation distance from the back surface of the main body 20 up to the engagement part 22*d* of the side plate 22 in a no-load condition, and the elasticity caused by the side plates 22, 22 located on both sides of the main body 20 being elastically deformed by the difference therebetween in the extending direction of the linear part 14*a* works so that the back surface of the main body 20 is pressed against the evaporation pipe 14, thereby bringing the evaporation pipe 14 into close contact with the main body 20 so that heat can be exchanged favorably.

First, the process of assembling the ice making section 10 is described. By inserting the linear part 14*a* of the evaporation pipe 14 through each hole 16*a* of the plurality of mounting members 16, the plurality of mounting members 16 are arranged so as to be substantially in parallel at a predetermined interval in the extending direction of the linear part 14*a* relative to the evaporation pipe 14. The ice making member 18 is then mounted between the pair of mounting members 16, 16 adjacent to each other in the extending direction of the linear part 14*a*. Specifically, the ice making member 18 is inserted between the mounting members 16, 16 from above (or from below) so that the engagement parts 22*d*, 22*d* in the ice making member 18 engage with the parts to be engaged 16*b*, 16*b* from the side of the evaporation pipe 14. At this time, the back surface of the main body 20 is mounted by the elastic force caused by both side plates 22, 22 in the ice making member 18 being elastically deformed as mentioned above (its own elasticity) in close contact with the linear part 14*a* of the evaporation pipe 14. Also, since the engagement parts 22*d*, 22*d* of the ice making member 18 engage with the parts to be engaged 16*b*, 16*b* of the mounting members 16, 16 from the side of the evaporation pipe 14 over almost the entire length of the longitudinal direction of the mounting member 16 and the ice making member 18, the back surface of the main body 20 in the ice making member 18 is pressed against the evaporation pipe 14 over the entire length of the back surface. By thus mounting each ice making member 18 between each pair of mounting members 16, 16 adjacent to each other in the extending direction of the linear part 14*a*, the ice making section 10 in which the ice making plate 12 composesd of the plurality of ice making members 18 is oppositely positioned on both sides across the evaporation pipe 14 is configured. The ice making section 10 thus assembled is positioned at a predetermined location in the ice making machine and incorporated by connecting the evaporation pipe 14 to the refrigerating system.

When starting the ice making process of the stream down type ice making machine into which the ice making section 10 is incorporated, a coolant is circulatingly supplied through the evaporation pipe 14 and ice making water is supplied onto the ice making surface of each ice making plate 12 (ice making area of each ice making member 18) through the ice making water supplying means. The ice making water which streams down in the ice making area of each ice making member 18 is cooled; the ice making water gradually starts freezing in a part which is in contact with the evaporation pipe 14; and finally a plurality of semicircular ice blocks C are made being separated vertically in each ice making member 18 (see FIG. 4). It should be noted that since each ice making member 18 is brought into close contact with the evaporation pipe 14 by its own elasticity, efficient cooling is achieved by the evaporation pipe 14. Also, since the remaining deicing water supplied between the opposing surfaces of the ice making plates 12, 12 in the previous deicing process freezes, even if a slight gap should be formed between the ice making member 18 and the evaporation pipe 14, the ice transfers heat in a favorable manner by the freezing of the deicing water remaining in the gap, thereby suppressing a decrease in cooling efficiency.

Shifting to the deicing process, hot gas is circulatingly supplied through the evaporation pipe 14 and deicing water is supplied between the opposing surfaces of the pair of ice making plates 12, 12 through the deicing water supplying means, thereby melting the frozen surface between the ice making surface and the ice block C. Also in this case, since each ice making members 18 is brought into close contact with the evaporation pipe 14 by its own elasticity, heat is efficiently exchanged with the evaporation pipe 14, thereby melting the frozen surface between the ice making surface and the ice block C in a short period of time. When the frozen surface melts completely, the ice block C slides down on the ice making surface due to its own weight. At this time, the ice block C gets on the projection 24 and moves in an outward direction away from the surface of the main body 20. Since the separation interval between the pair of first sides 22*b*, 22*b* is set to be wider than the separation interval between the second sides 22*c*, 22*c* in the ice making member 18 as mentioned above, a wide gap is formed between the opposing surfaces of the ice block C separating from the surface of the main body 20 and the side plates 22, 22, thereby dropping the ice block C reliably. Specifically, when the gap formed between the side plates 22, 22 and the ice block C is small, the ice block C may not drop easily due to the surface tension of water melted from ice or the like, which can cause the ice block to remain in the next ice making process allowing double ice making. According to the configuration of Example 1, however, the ice block C can be dropped from the ice making plate 12 immediately, thereby preventing double ice making. Also, since the open end of the ice making member 18 (part in which the engagement part 22*d* and the part to be engaged 16*b* engage with each other) is configured so as not to have large irregularities, the ice making process can be prevented from starting with the ice block C in the middle of dropping being caught and remaining on the ice making plate 12.

As described above, since the present invention is configured so that the ice making member 18 is mounted through the mounting members 16, 16 arranged on the evaporation pipe 14, complicated operations such as brazing and welding become unnecessary, thereby reducing facility cost. Also, since elasticity of the ice making member 18 can bring the back surface of the ice making member 18 (main body 20) into close contact with the evaporation pipe 14, a decrease in heat exchange efficiency caused by the gap formed between the evaporation pipe 14 and the ice making member 18 can be prevented, thereby suppressing a decrease in daily ice making capacity.

Long-term use of the ice making section 10 leads to stains adhering between the opposing surfaces of the pair of ice making plates 12, 12, which requires cleaning. In this case, by pulling out each ice making member 18 composing each ice making plate 12 upwardly (or downwardly) so that the engagement parts 22*d*, 22*d* separate from the parts to be engaged 16*b*, 16*b* of the mounting members 16, 16, the ice making member 18 can be easily cleaned outside. It should be noted that since by removing all the ice making members 18 located on either side of the evaporation pipe 14, the back surface of the main body 20 in each ice making member 18 located on the other side thereof (opposing surface on the ice making plate 12) is exposed, easy cleaning of the back surface becomes possible in this state.

Specifically, since easy cleaning between the opposing surfaces of the pair of ice making plates 12, 12 is possible, the portion can be kept clean therebetween at all times. Also, since the ice making plate 12 is composed of the plurality of ice making members 18, if rust is formed in a part of the ice making members 18 or a part thereof is deformed or damaged, the measure responding to this situation can be taken by removing only the relevant ice making member 18 from the mounting members 16, 16 and then mounting a new ice making member 18. Therefore, the entire first ice making section 10 does not have to be replaced, thereby reducing the cost required for replacement. It should be noted that since the part to be engaged 16*b* and engagement part 22*d* can be attachable to and detachable from each other as an assembling means without using any tool, the operations of mounting and removing the ice making member 18 are extremely easy.

Furthermore, when the ice making plate 12 is composed of the plurality of ice making members 18, the ice making plate 12 of the size commensurate with the ice making capacity of individual ice making machines can be configured by changing the number of the mounting members 16 arranged corresponding to the evaporation pipe 14 so as to change the number of the ice making members 18 arranged. Specifically, without the need for preparing ice making plates of different sizes, a common ice making member 18 can compose ice making plates 12 of various sizes, which is advantageous in terms of excellent versatility.

Figure 6:
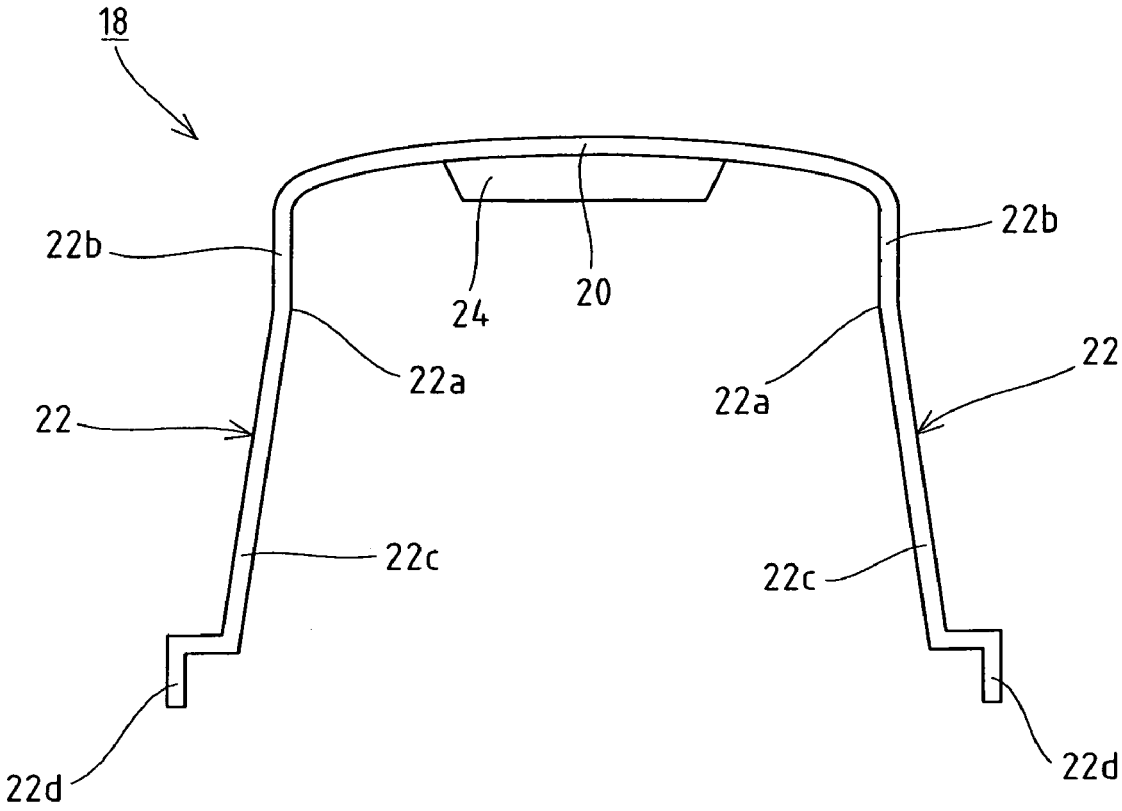
FIG. 6 is a plan view showing an exemplary modification of an ice making member in the ice making section.

As shown in FIG. 6, when forming the main body 20 in the ice making member 18 curvedly so as to protrude into the back side (the evaporation pipe side) so that the engagement parts 22*d*, 22*d* engage with the parts to be engaged 16*b*, 16*b* in the mounting members 16, 16 from the side of the evaporation pipe 14, the back surface of the main body 20 may be brought into close contact with the evaporation pipe 14 more rigidly by elastically deforming by the difference made by the main body 20 being protruded. Specifically, in the configuration shown in FIG. 6, since the main body 20 is pressed against the evaporation pipe 14 by the elastic deformation of both side plates 22, 22 in the ice making member 18 so that the main body 20 is further elastically deformed so as to be in close contact with the evaporation pipe 14, the back surface thereof is brought into closer contact with the evaporation pipe 14, thereby reliably preventing a gap from being formed between 20 and 14.

In the ice making machine shown in FIGS. 1 to 5, the plurality of ice making members having one row of ice making area compose the ice making plate. For example, however, in a configuration where a plurality of ice making members, having two rows or more of ice making areas in parallel compose the ice making plate, it is only necessary in each ice making member to engage the engagement part formed at the open end of the side plate located at the outermost with the part to be engaged of the corresponding mounting member. Also, the part to be engaged or the engagement part does not have to be formed over the entire length in the longitudinal direction of the mounting member or the ice making member, nor being limited to a specific form as long as the back surface of the main body in the ice making member can be assembled so as to be in contact with the evaporation pipe.

Figure 7:
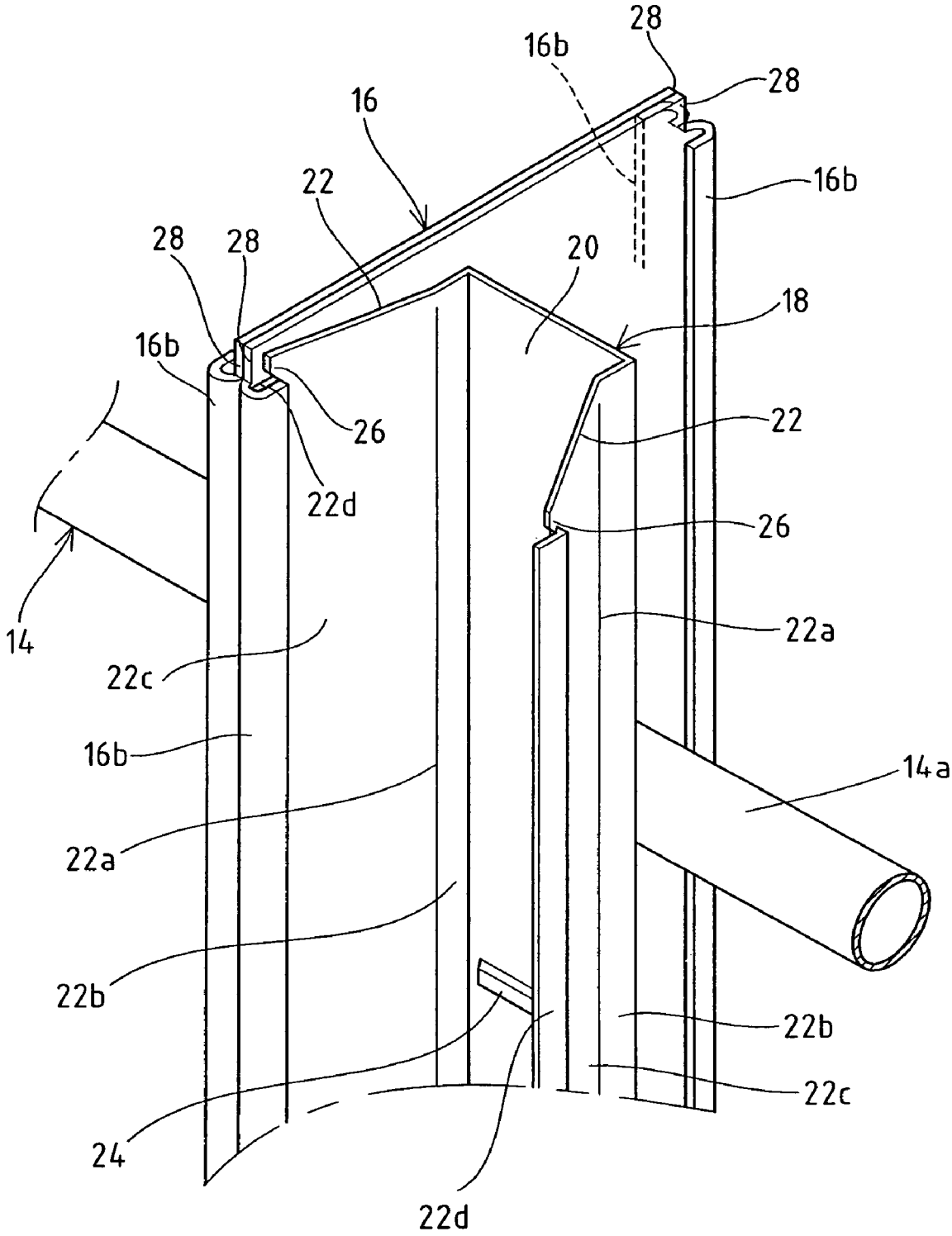
FIG. 7 is an exploded perspective view showing a substantial part of an ice making section of a stream down type ice making machine.
Figure 8:
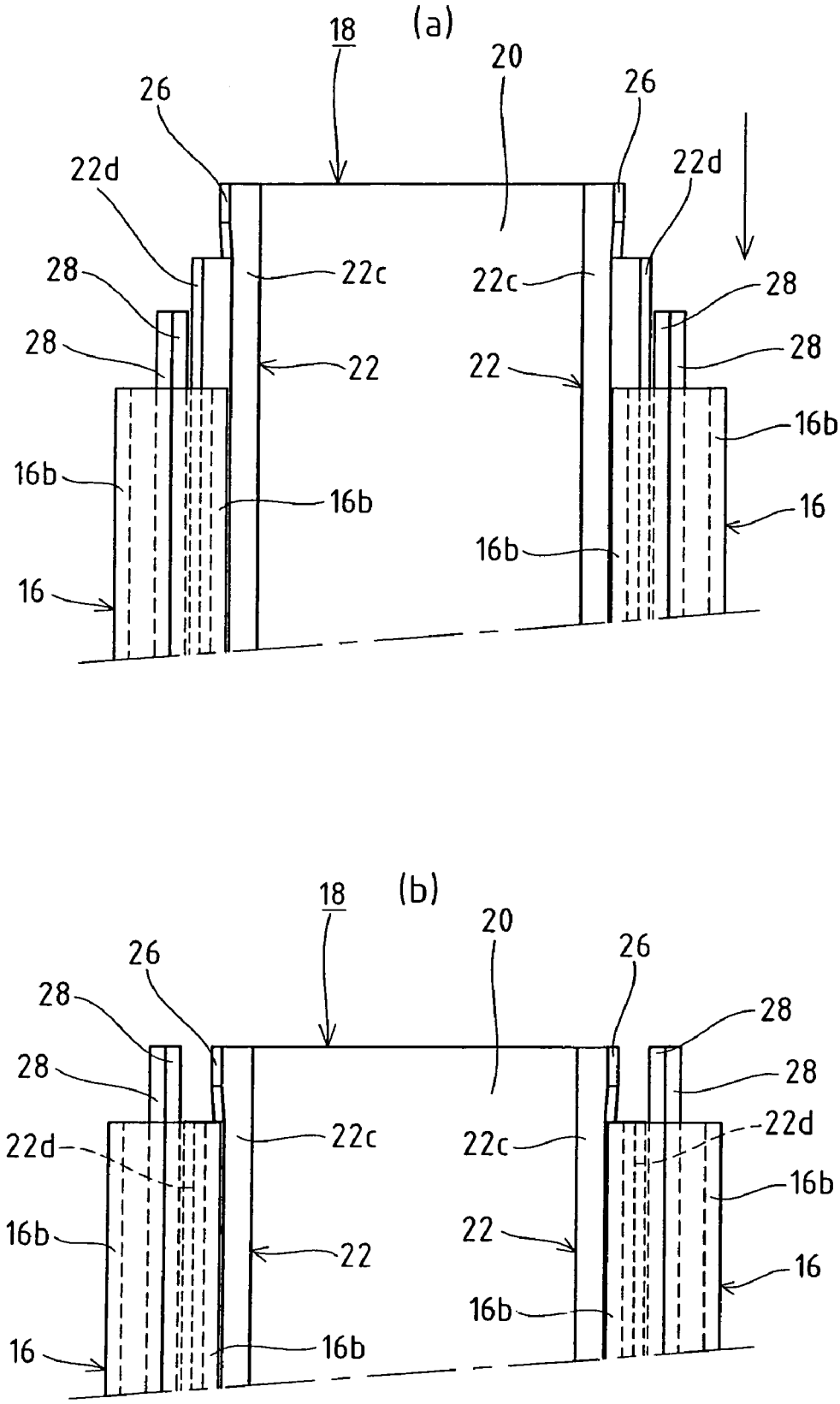
FIG. 8 is an explanatory drawing showing a state in which an ice making member is assembled relative to a mounting member.

FIG. 7 and FIG. 8 show an ice making section according to another example of the stream down type ice making machine. Since the configuration thereof is the same as that shown in FIGS. 1 to 5, a description is given only for different parts.

At the open end where the engagement part 22*d* on each side plate 22 of the ice making member 18 is formed, a part (upper end) in which no engagement part 22*d* is formed from the upper end therof toward the bottom side is set corresponding to a predetermined height, where a first regulation part 26 incapable of being inserted into the part to be engaged 16 of the mounting member 16 from either above or below (that is, unengageable) is each formed. Also, at the open end (end edge) where each part to be engaged 16*b* in the mounting member 16 is formed, each first cutout 28 in which no part to be engaged 16*b* is formed from the upper end thereof toward the bottom side is provided corresponding to the height approximately equal to the height of the first regulation part 26. When the engagement parts 22*d*, 22*d* of the ice making member 18 is inserted into the parts to be engaged 16*b*, 16*b* of the mounting member 16 from above (see FIG. 8(*a*)), each of the first regulation parts 26 is brought into contact with the upper end of the corresponding part to be engaged 16*b* for position control so as to prevent further insertion and to make the upper end of the ice making member 18 and the upper end of the mounting member 16 approximately on the same level (see FIG. 8(*b*)).

Specifically, since the positioning of the ice making member 18 relative to the mounting members 16, 16 can be determined by the first regulation parts 26, 26 in the ice making member 18, the positioning operation when assembling the ice making plate 12 becomes easy. Also, since the engagement parts 22*d*, 22*d* cannot be inserted into the parts to be engaged 16*b*, 16*b* of the mounting members 16, 16 from the side of the end where the first regulation parts 26, 26 are formed in the ice making member 18, the ice making member 18 can be prevented from being mounted upside down relative to the mounting members 16, 16. This enables the prevention of inconvenience that may arise caused by the projection 24 provided in the ice making member 18 positioned deviating from the proper position. It should be noted that the side of the end portion where no first regulation parts 26, 26 are formed can be inserted from the lower part of the mounting members 16, 16 by turning the ice making member 18 upside down. In this case, however, since the ice making member 18 downwardly protrudes from the lower ends of the mounting members 16, 16 by the height corresponding to the heights of the first regulation parts 26, 26 when the first regulation parts 26, 26 make contact with the lower ends of the parts to be engaged 16*b*, 16*b*, an operator can check for improper mounting.

While the example shown in the figures has been described for a case in which the first regulation part 26 and the first cutout 28 are provided at the upper ends of the ice making member 18, and the mounting member 16, the configuration in which the first regulation part 26 and the first cutout 28 are provided at the lower ends of the ice making member 18 and the mounting member 16 is also applicable. In this case, positioning is determined by inserting the side of the upper end of the ice making member 18 where no first regulation parts 26, 26 are formed, from the lower part of the mounting members 16, 16, and bringing the first regulation parts 26, 26 into contact with the lower ends of the parts to be engaged 16*b*, 16*b*.

Figure 9:
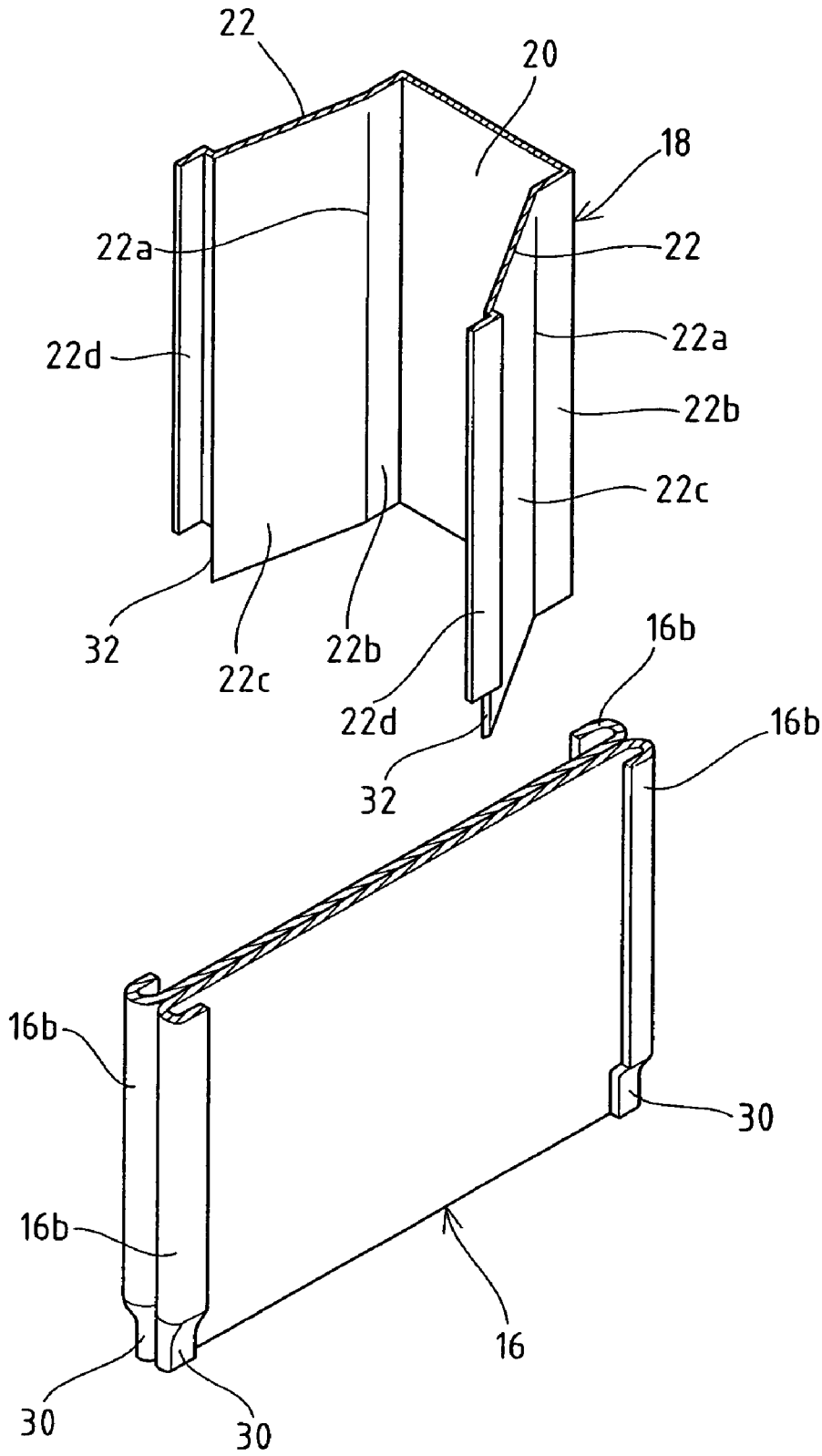
FIG. 9 is an exploded perspective view showing a substantial part of an ice making section of a stream down type ice making machine.
Figure 10:
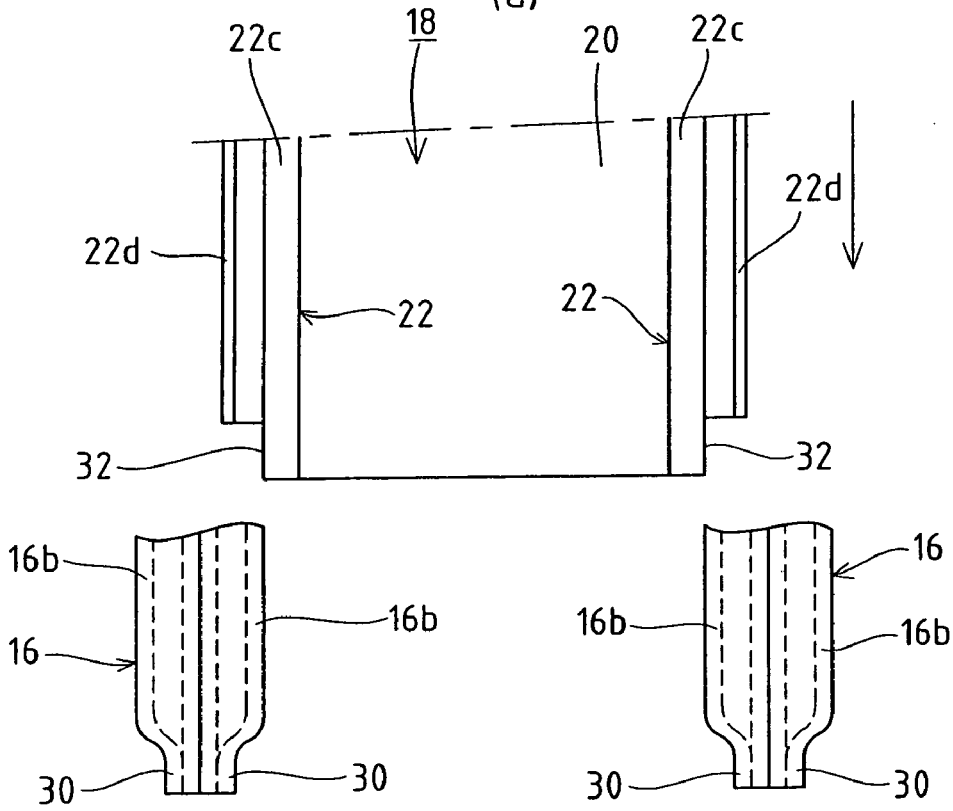
FIG. 10 is an explanatory drawing showing a state in which an ice making member is assembled relative to a mounting member.
Figure 10:
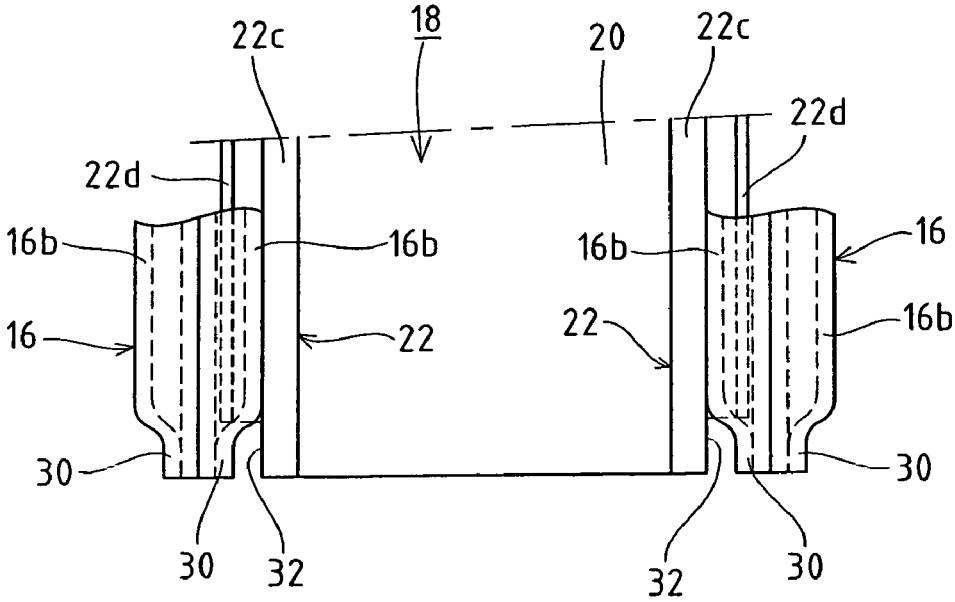

FIG. 9 and FIG. 10 show an ice making section according to yet another example of the stream down type ice making machine. At the lower end of the open end (end edge) where each part to be engaged 16*b* of the mounting member 16 is formed, a second regulation part 30 where the engagement part 22*d* of the ice making member 18 cannot be inserted from neither above nor below (that is, unengageable) is formed for each by caulking the part to be engaged 16*b* from the lower end thereof toward the upper side corresponding to a predetermined height. Also, at the open end where the engagement part 22*d* in each side plate 22 of the ice making member 18 is formed, there is provided a second cutout 32 where no engagement part 22*d* is formed from the lower end thereof toward the upper side corresponding to a predetermined height. When the engagement parts 22*d*, 22*d* of the ice making member 18 is inserted into the parts to be engaged 16*b*, 16*b* of the mounting member 16 from above (see FIG. 10(*a*)), the lower end of each engagement part 22*d* makes contact with the upper end of the corresponding second regulation part 30 (part facing the lower end inside the part to be engaged 16*b*) for position control so as to prevent further insertion and to make the lower end of the ice making member 18 and the lower end of the mounting member 16 approximately on the same level (see FIG. 10(*b*)).

Specifically, since the positioning of the ice making member 18 relative to the mounting members 16, 16 can be determined by the second regulation part 30 in the mounting member 16, the positioning operation when assembling the ice making plate 12 becomes easy. Also, in a state in which the engagement parts 22*d*, 22*d* are inserted from the end side where the second cutouts 32, 32 of the ice making member 18 are provided into the parts to be engaged 16*b*, 16*b* from above relative to the mounting members 16, 16, so that the engagement parts 22*d*, 22*d* are in contact with the second regulation parts 30, 30, the positionings of the upper and lower ends of the ice making member 18 are determined so as to be approximately on the same level as the upper and lower ends of the mounting members 16, 16 On the other hand, in a state in which the engagement parts 22*d*, 22*d* are inserted from the end side where no second cutouts 32, 32 of the ice making member 18 are provided into the parts to be engaged 16*b*, 16*b* from above relative to the mounting members 16, 16 so that the engagement parts 22*d*, 22*d* are in contact with the second regulation parts 30, 30, the positions of the upper and lower ends of the ice making member 18 are different from the positions of the upper and lower ends of the mounting members 16, 16 by the height corresponding to the height of the second regulation part 30 (second cutout 32), which enables the check on the ice making member 18 mounted upside down. This enables the prevention of the ice making member 18 mounted upside down on the mounting members 16, 16 by an operator and the prevention of inconvenience that may arise caused by the projection 24 provided in the ice making member 18 positioned deviating from the proper position.

While the example shown in the figures has been described for a case in which the second regulation part 30 and the second cutout 32 are provided at the lower ends of the ice making member 18 and the mounting member 16, the configuration in which the second regulation part 30 and the second cutout 32 are provided at the upper ends of the ice making member 18 and the mounting member 16 is also applicable. In this case, positioning is determined by inserting the side of the upper end of the ice making member 18 where the second cutouts 32, 32 are formed, from the lower part of the mounting members 16, 16, and bringing the engagement parts 22*d*, 22*d* into contact with the lower ends of the second regulation parts 30, 30.

For the ice making machine shown in FIGS. 1 to 10, the plurality of ice making members having one row of ice making area compose the ice making plate. For example, in a configuration where a plurality of ice making member having two rows or more of ice making areas in parallel compose the ice making plate. In this case, it is only necessary in each ice making member to engage the engagement part formed at the open end of the side plate located at the outermost with the part to be engaged of the corresponding mounting member. Also, the part to be engaged or the engagement part does not have to be formed over the entire length in the longitudinal direction of the mounting member or the ice making member, nor being limited to a specific form as long as the back surface of the main body in the ice making member can be assembled so as to be in close contact with the evaporation pipe. Furthermore, while the ice making member is configured so as to be attachable and detachable, the ice making member may be fixed to the mounting member by a screw or other fixing means.

FIG. 11 to FIG. 15 show an ice making section according to another example of the stream down type ice making machine. The ice making section 126 comprises a pair of ice making plates 128, 128 approximately perpendicularly arranged and an evaporation pipe 14 held between the opposing surfaces (between the back surfaces) of both ice making plates 128, 128 composing a refrigerating system whose linear part 14*a* meanderingly extends in a transverse direction. The ice making section 126 is thus configured to forcibly cool the ice making plates 128, 128 by circulating a coolant through the evaporation pipe 14 during the ice making process. It should be noted that there are provided an ice making water supplying means for supplying ice making water onto the surface (ice making surface) of each ice making plate 128 during the ice making process and a deicing water supplying means for supplying deicing water between the opposing surfaces of both ice making plates 128, 128 during the deicing process at the upper portion of the second ice making section 126 (neither shown). Also, hot gas (high temperature coolant) is supplied through the evaporation pipe 14 by switching a valve of the refrigerating system during the deicing process. The ice making plates 128, 128 are made of a material of relatively low thermal conductivity such as stainless plate, the evaporation pipe 14 is made out of a material of relatively high thermal conductivity such as copper pipe, but other materials may be employed.

Figure 12:
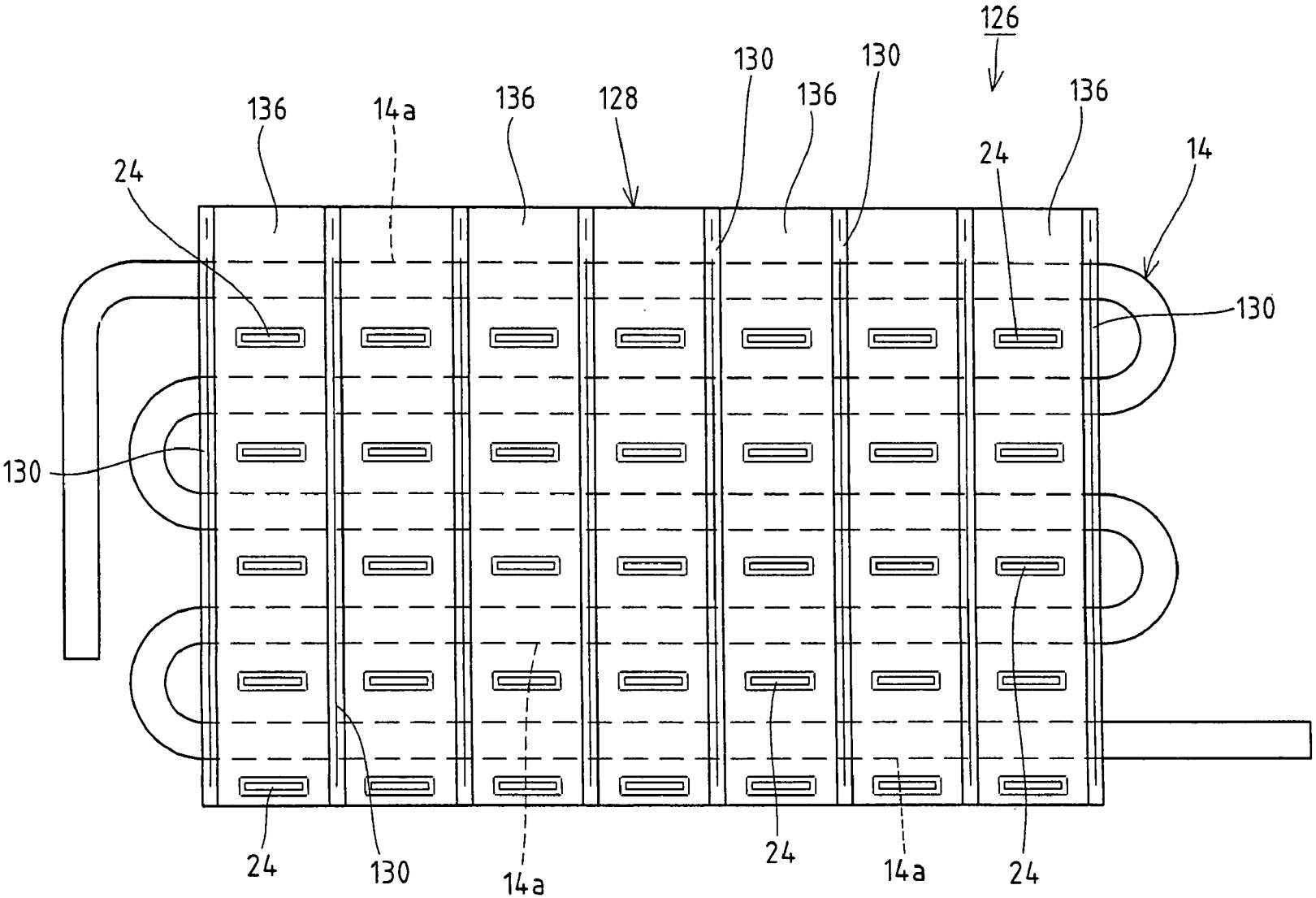
FIG. 12 shows a front view of the ice making section.

The ice making plate 128 is formed so that a plurality of partitioning projections 130 of a V-shaped cross section vertically extending in parallel protrude into the front surface side by bending a thin stainless steel plate into a V-shape at a predetermined interval in the width direction (the extending direction of the linear part 14*a* of the evaporation pipe 14. Also, a main body 136 vertically extending substantially in parallel with the evaporation pipe 14 is formed between the pair of partitioning projections 130, 130 adjacent to each other in the width direction. The inner part surrounded by the main body 136 and the pair of partitioning projections 130, 130 becomes an ice making area, and ice making water is supplied so as to stream down to the the ice making area through the ice making water supplying means. It should be noted that a plurality of projections 24 are vertically formed at a predetermined interval on each of the main bodies 136 as shown in FIG. 12, and that each projection 24 is set so as to appear between the linear parts 14*a*, 14*a* of the evaporation pipe 14 located above and below.

Figure 11:
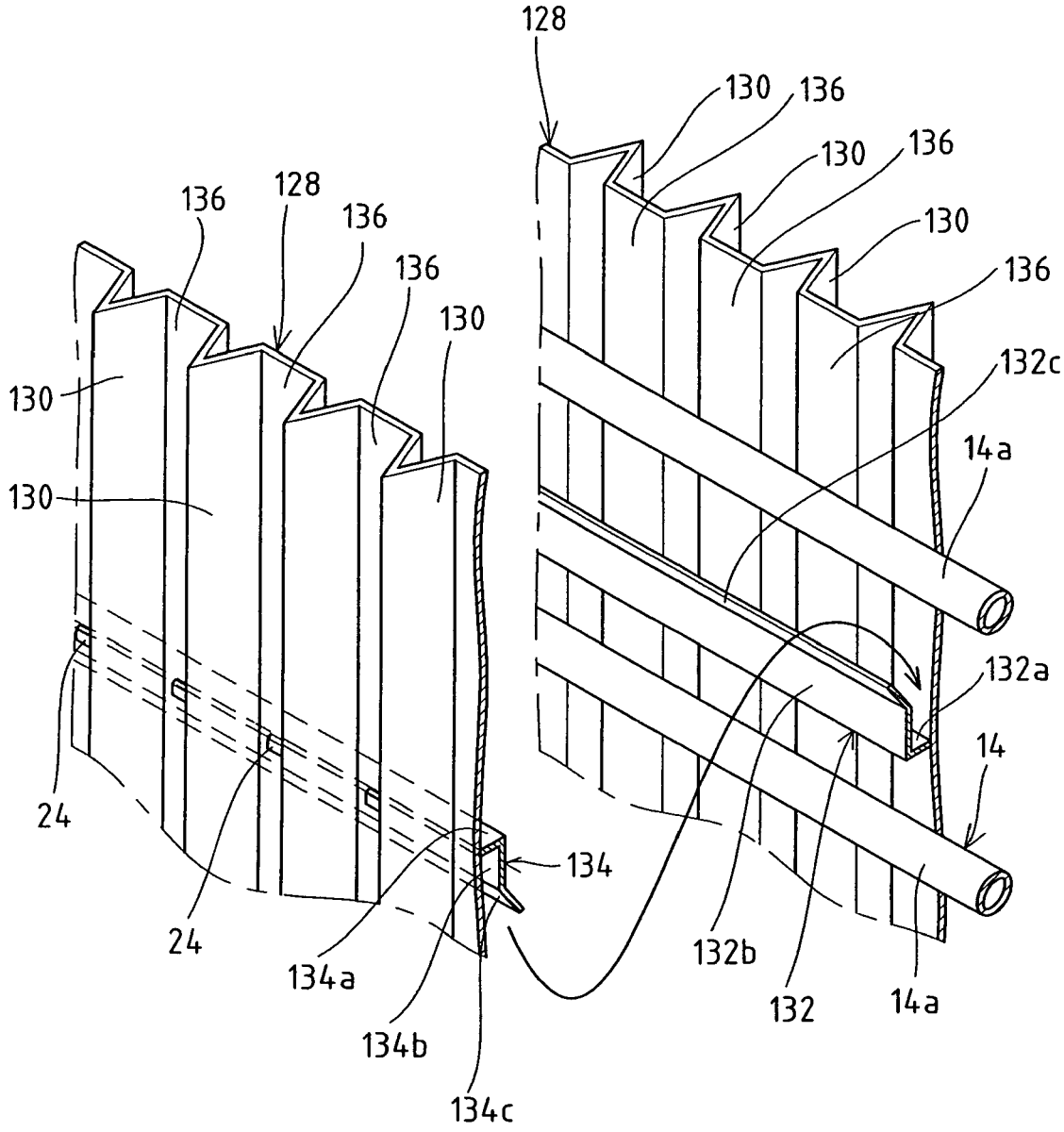
FIG. 11 is an exploded perspective view showing a substantial part of an ice making section of a stream down type ice making machine.
Figure 14:
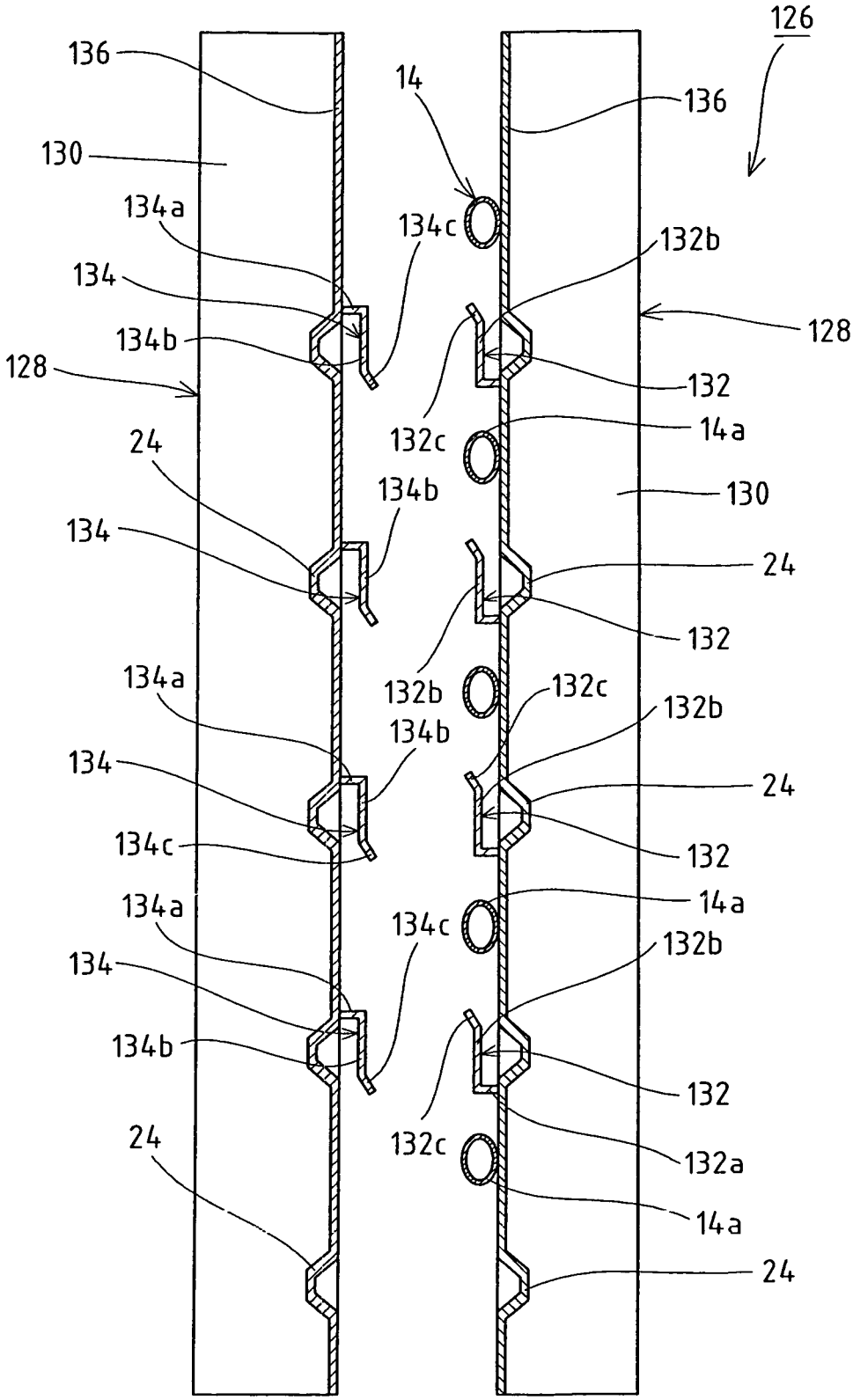
FIG. 14 shows a longitudinal sectional side view of the ice making section.
Figure 15:
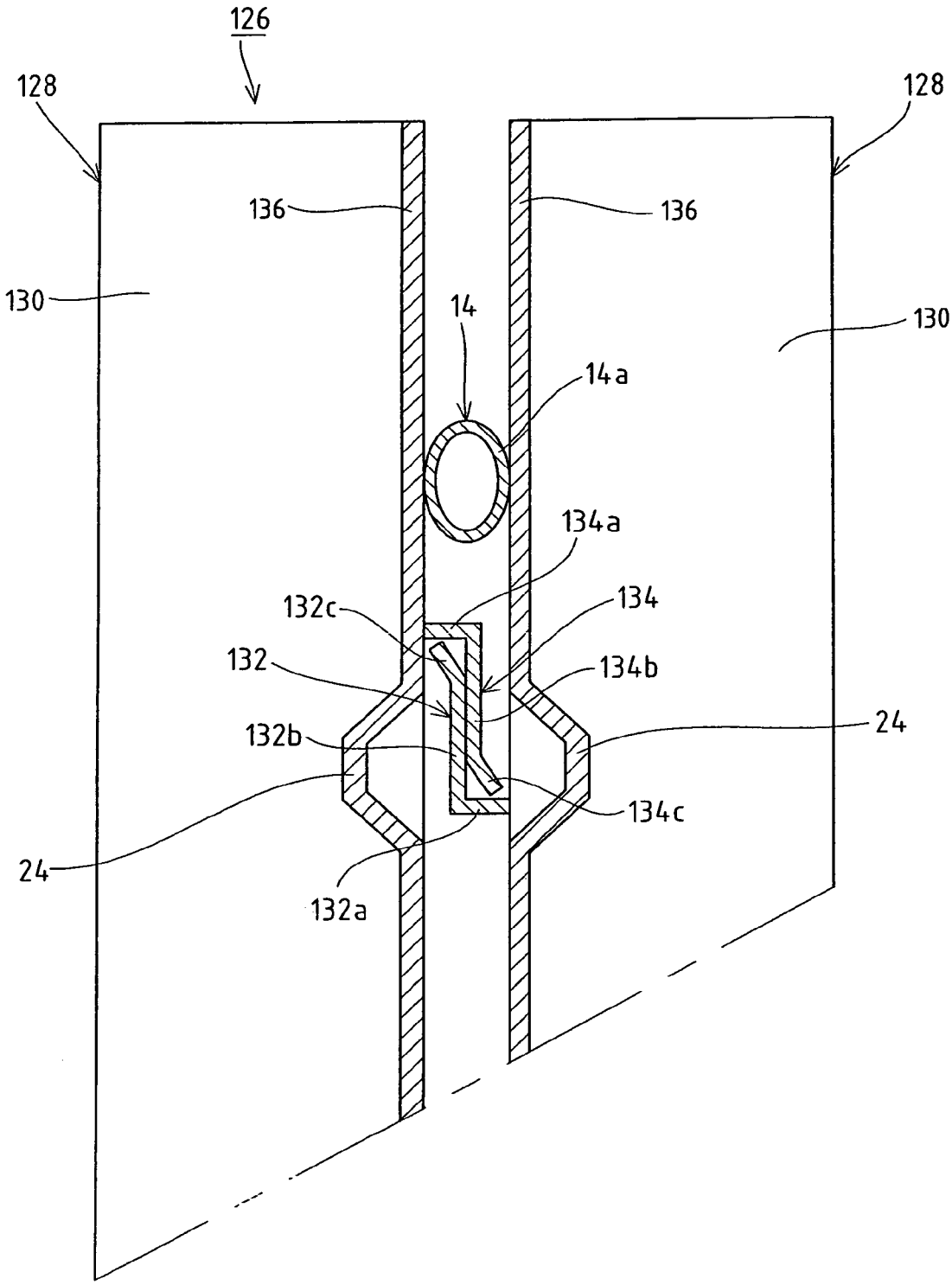
FIG. 15 is a longitudinal sectional side view showing a substantial part of the ice making section.

On the back surface of the either ice making plate 128, as shown in FIG. 11 and FIG. 14, a plurality of pieces to be engaged 132, which are open toward the upper side, are arranged so as to extend in parallel over almost the entire length in the width direction being vertically separated at a predetermined interval, at a position where the piece to be engaged 132 does not interfere with the evaporation pipe 14, that is a position where the piece to be engaged 132 appears between the linear parts 14*a*, 14*a* located above and below the evaporation pipe 14. The piece to be engaged 132 comprises an extended part 132*a* horizontally extending substantially orthogonally relative to the main body 136 of the ice making plate 128, a contact part 132*b* formed by upwardly bending substantially orthogonally at the extended end of the extended part 132*a*, and an open end 132*c* formed by bending at a predetermined angle in a direction away from the ice making plate 128 corresponding at the upper end of the contact part 132*b*.

In contrast, on the back surface of the other ice making plate 128, a plurality of engagement pieces 134, which are open toward the bottom side, engagable with and disengageable from the respective corresponding pieces to be engaged 132, are arranged so as to extend in parallel over almost the entire length in the width direction being vertically separated at a predetermined interval, at a position where the engagement piece 134 does not interfere with the evaporation pipe 14, that is a position where the engagement piece 134 appears between the linear parts 14*a*, 14*a* of the evaporation pipe 14 located above and below, similarly to the abovementioned pieces to be engaged 132. The engagement piece 134 comprises an extended part 134*a* horizontally extending substantially orthogonal relative to the main body 136 of the ice making plate 128, a contact part 134*b* formed by downwardly bending substantially orthogonally at the extended end of the extended part 134*a*, and an open end 134*c* formed by bending at a predetermined angle in a direction away from the ice making plate 128 corresponding at the lower end of the contact part 134*b*. The pair of ice making plates 128, 128 are configured for assembly so as to face each other across the evaporation pipe 14 between the back surfaces thereof, by inserting each engagement piece 134 corresponding to each piece to be engaged 132 from above so that both contact parts 132*b*, 134*b* are engaged in contact with each other (see FIG. 15). Specifically, the piece to be engaged 132 provided on the either ice making plate 128 and the engagement piece 134 provided on the other ice making plate 128 composes an assembling means for assembling both ice making plates 128, 128 detachably.

Both of the piece to be engaged 132 and the engagement piece 134 are elastic. The separation distance between the opposing surfaces of both ice making plates 128, 128 is set to be shorter than the diameter of the evaporation pipe 14 in the corresponding direction when engaging the piece to be engaged 132 with the engagement piece 134, with the evaporation pipe 14 not being held between the two ice making plates 128, 128. With the evaporation pipe 14 being held between the two ice making plates 128, 128, the separation distance is set so that both engagement pieces 132, 134 are elastically deformed and their elasticity works to bring the back surface of each ice making plate 128 (back surface of the main body 136) into close contact with the evaporation pipe 14. It should be noted that the piece to be engaged 132 and the engagement piece 134, both of which extend substantially in parallel with the linear part 14*a* of the evaporation pipe 14, are configured so that the whole part facing the linear part 14*a* of the main body 136 in each ice making plate 128 can be reliably brought into close contact with the linear part 14*a*.

Figure 13:
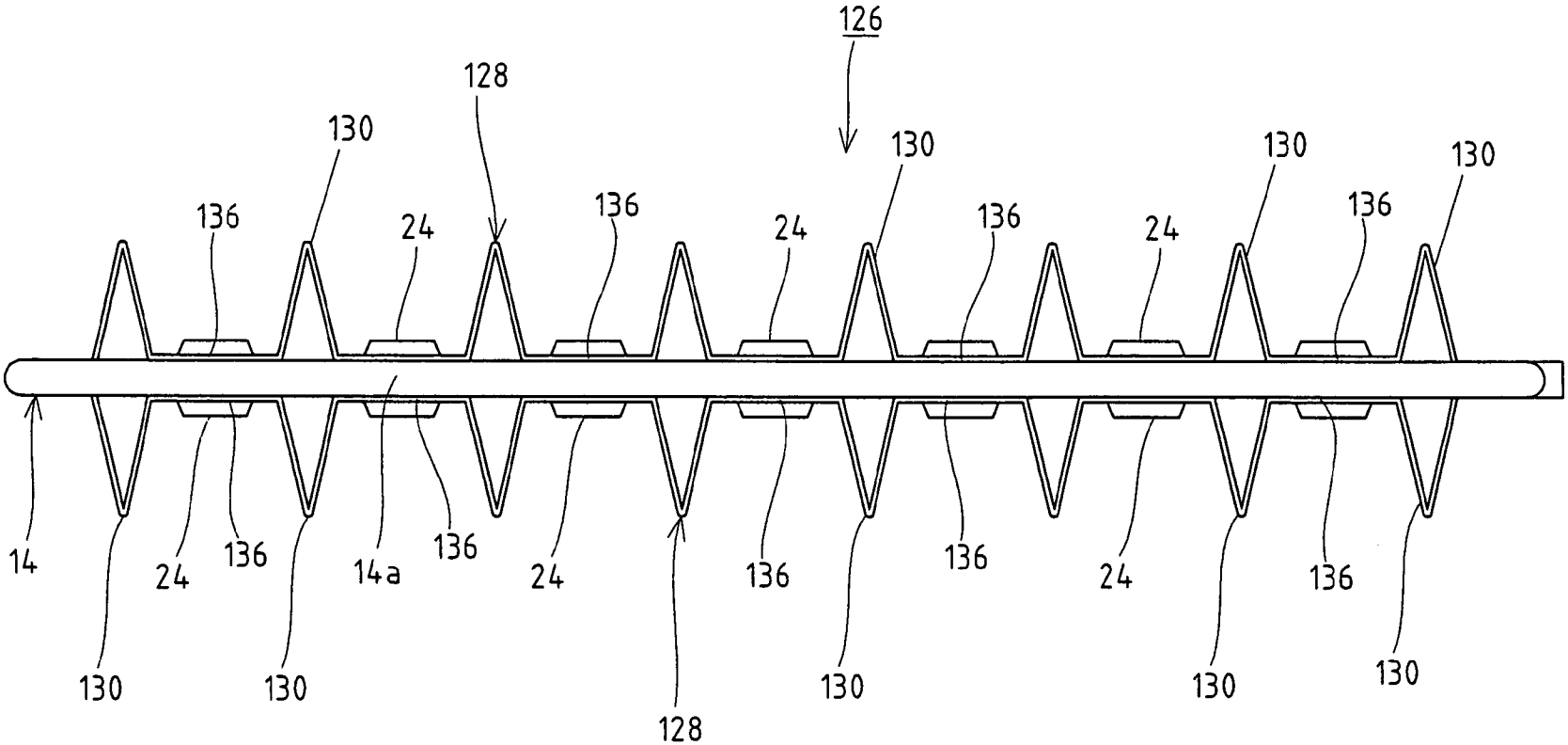
FIG. 13 shows a plan view of the ice making section.

Next, a description is given for the process of assembling the ice making section 126 shown in FIGS. 11 to 15. By positioning one ice making plate 128 on either surface of the evaporation pipe 14, with the evaporation pipe 14 being laid between a pair of holding members (not shown), each engagement piece 134 of another ice making plate 128 facing the other surface of the evaporation pipe 14 is engaged with each piece to be engaged 132 of the ice making plate 128. As a result, the pair of ice making plates 128, 128 is assembled in a state interposing the evaporation pipe 14 therebetween as shown in FIG. 13. In this case, due to the elasticity caused by the elastic deformation of the piece to be engaged 132 and the engagement piece 134, the back surfaces of both ice making plates 128, 128 (back surface of the main body 136) are brought into close contact with the linear part 14*a* of the evaporation pipe 14, so that heat can be exchanged with the evaporation pipe 14 efficiently. It should be noted that since the piece to be engaged 132 and the engagement piece 134 extend substantially in parallel with the linear part 14*a* in the evaporation pipe 14, the above-mentioned elasticity is utilized for reliably bringing the whole part facing the linear part 14*a* of the main body 136 in each ice making plate 128 into close contact with the linear part 14*a*. The second ice making section 126 is configured by thus mounting both ice making plates 128, 128 across the evaporation pipe 14. It should be noted that since the open ends 132*c*, 134*c* of the piece to be engaged 132 and the engagement piece 134 are bent at a predetermined angle in a direction away from the corresponding ice making plates 128, 128, the engagement piece 134 can be engaged with the piece to be engaged 132 easily. As described above, the assembled ice making section 126 assembled as described above is positioned at a predetermined location in the ice making machine and incorporated by connecting the evaporation pipe 14 to the refrigerating system.

When starting the ice making process of the stream down type ice making machine into which the ice making section 126 is incorporated, a coolant is circulatingly supplied through the evaporation pipe 14 and ice making water is supplied onto the ice making surface of each ice making plate 128 (each ice making area) through the ice making water supplying means. The ice making water which streams down in each ice making area is cooled; the ice making water gradually starts freezing in a part which is in contact with the evaporation pipe 14; and finally a plurality of semicircular ice blocks are made being separated vertically in each ice making area. It should be noted that since each ice making plate 128 is brought into contact with the evaporation pipe 14 by elasticity of the piece to be engaged 132 and the engagement piece 134 as described above, efficient cooling by the evaporation pipe 14 is achieved.

Shifting to the deicing process, hot gas is circulatingly supplied throught the evaporation pipe 14 and deicing water is supplied between the opposing surfaces of the pair of ice making plates 128, 128 through the deicing water supplying means, thereby melting the frozen surface between the ice making surface and the ice block. Also in this case, since each of the ice making plates 128 is brought into close contact with the evaporation pipe 14 by elastic force of the the piece to be engaged 132 and the engagement piece 134, heat is efficiently exchanged with the evaporation pipe 14, thereby melting the frozen surface between the ice making surface and the ice block in a short period of time. When the frozen surface melts completely, the ice block slides down on the ice making surface due to its own weight. At this time, the ice block gets on the projection 24 and moves outwardly away from the surface of the main body 136, so that a wide gap is formed between the ice block and the the surface, thereby dropping the ice block reliably.

Since the ice making machine shown in the figures is configured so that both ice making plates 128, 128 are mounted through the piece to be engaged 132 and the engagement piece 134 arranged in the ice making plates 128, 128, complicated operations such as brazing and welding become unnecessary, thereby reducing facility cost. Also, since the back surface of each ice making plate 128 (main body 136) can be brought into close contact with the evaporation pipe 14 by elasticity of the piece to be engaged 132 and the engagement piece 134, a decrease in heat exchange efficiency caused by the gap formed between the evaporation pipe 14 and each ice making plate 128 can be prevented, thereby suppressing a decrease in daily ice making capacity.

Long-time use of the ice making section 126 also leads to stains adhering between the opposing surfaces of the pair of ice making plates 128, 128, which requires cleaning. In such a case, one ice making plate 128 is pulled out upward so that each engagement piece 134 is removed from the corresponding piece to be engaged 132 on the other ice making plate 128. This enables the pair of ice making plates 128, 128 to be removed from the evaporation pipe 14 and to be easily cleaned outside, thereby it is possible to keep them clean at all times. Also, since replacement of each ice making plate 128 is possible, it is only necessary to replace one ice making plate 128 where rust is formed or which is deformed or damaged, without the high cost of replacing the whole ice making section 126. Furthermore, since every ice making plate 128 can be mounted and removed individually, the operations are simple.

While the ice making machine shown in FIGS. 11 to 15 has been described for a case in which the piece to be engaged and the engagement piece are continuously formed over the entire length of the ice making plate in the width direction, they may be formed discontinuously in the width direction and the shapes and arrangement numbers thereof can be set arbitrarily. Furthermore, while a description has been given for a case in which the ice making plate is made out of one plate, the ice making plate may be composed of a plurality of ice making bodies into which are divided so that the piece to be engaged or engagement piece is provided in each ice making body. It should be noted that while the ice making machine shown in FIGS. 11 to 15 is configured to be detachable, a configuration in which the two ice making plates are fixed by a screw or other fixing means with the piece to be engaged being engaged with the engagement piece is applicable. Also, the contact parts of the piece to be engaged and the engagement piece may be bent so that the angles thereof on the side of the ice making plate corresponding to the extended part are acute.

Also, while in the ice making machine shown in FIGS. 11 to 15, a pair of ice making plates is assembled by engaging the piece to be engaged with the engagement piece, a configuration in which at least either of the ice making plates is made of a magnetic material and a magnet is fixed to a position on the back surface of the other ice making plate not interfering with the evaporation pipe so that the pair of ice making plates are assembled by the magnet in a state of holding the evaporation pipe therebetween, is also applicable. Also, the pair of ice making plates can be assembled by fixing magnets to the two ice making plates in an opposing manner so that the two magnets attract each other by magnetic force.

The invention claimed is:

1. An ice making section of the stream down type ice making machine which comprises a pair of ice making plates and an evaporation pipe laid meanderingly between back surfaces of the two ice making plates, a coolant being circulatingly supplied therethrough for making an ice block by supplying ice making water which streams down onto a surface of each ice making plate cooled by supplying the coolant through the evaporation pipe circulatingly, wherein:

said pair of ice making plates are assembled so as to be attachable to and detachable from each other through an assembling means so that the back surfaces thereof are in contact with said evaporation pipe, said ice making plate comprises a plurality of ice making members having an engagement part composing said assembling means, a plurality of mounting members having a part to be engaged comprising said assembling means with which said engagement part detachably engages are arranged in a linear part extending in a transverse direction of said evaporation pipe, being separated at a predetermined interval in the extending direction, and said ice making plate is configured by engaging said each engagement part with the corresponding part to be engaged so that the back surfaces of said ice making members are detachably assembled so as to be in contact with the evaporation pipe between mounting members adjacent to each other in the extending direction of said linear part.

2. An ice making section of the stream down type ice making machine which comprises a pair of ice making plates and an evaporation pipe laid meanderingly between back surfaces of the two ice making plates, a coolant being circulatingly supplied therethrough, for making an ice block by supplying ice making water which streams down onto a surface of each ice making plate cooled by supplying the coolant through the evaporation pipe circulatingly, wherein:

said pair of ice making plates are assembled so as to be attachable to and detachable from each other through an assembling means so that the back surfaces thereof are in contact with said evaporation pipes; and a piece to be engaged comprising said assembling means is provided on the back surface of either of said ice making plates; an engagement piece composing said assembling means is provided, being engagable with and disengageable from said piece to be engaged on the back surface of the other ice making plate; and the pair of ice making plates are configured for assembly so as to hold said evaporation pipe tightly by making the back surfaces of the two ice making plates face each other across said evaporation pipe and engaging said engagement piece with the piece to be engaged.

3. An ice making section of the stream down type ice making machine which comprises a pair of ice making plates and an evaporation pipe laid meanderingly between back surfaces of the two ice making plates, a coolant being circulatingly supplied therethrough, for making an ice block by supplying ice making water which streams down onto a surface of each ice making plate cooled by supplying the coolant through the evaporation pipe circulatingly, wherein:

said pair of ice making plates are assembled so as to be attachable to and detachable from each other through an assembling means so that the back surfaces thereof are in contact with said evaporation pipe; and said assembling means comprises:

a plurality of mounting members arranged in a linear part extending in a transverse direction of said evaporation pipe, located substantially in parallel in the extending direction being separated at a predetermined interval; and a plurality of ice making members being elastic which comprise said ice making plate, arranged between the mounting members adjacent to each other in the extending direction of said linear part, wherein:

said each ice making member mounted through said mounting members is elastically deformed and the elastic force works to bring the back surface of the ice making member into close contact with said evaporation pipe.

4. The ice making section of the stream down type ice making machine according to claim 3, wherein said each ice making member comprises a main body extending vertically; a pair of side plates formed by bending toward their front sides at both end edges in the main body in the extending direction of said linear part, which spread outward gradually as being away from the main body; and an engagement part formed at an open end of each side plate, wherein:

a part to be engaged is formed at both end edges in said mounting member extending vertically separated from said linear part, and when mounting said ice making member between the mounting members adjacent to each other in the extending direction of said linear part by engaging both of said engagement parts with the corresponding parts to be engaged, the back surface of said main body is brought into close contact with said evaporation pipe by elastic deformation of both of said side plates.

5. The ice making section of the stream down type ice making machine according to claim 4, wherein the main body of said each ice making member is curvedly formed so as to protrude into its back side, and by the main body being pressed against the evaporation pipe due to the elastic deformation of both of said side plates, the main body is further elastically deformed so as to be in close contact with the evaporation pipe.

6. The ice making section of the stream down type ice making machine according to claim 4, wherein a regulation part incapable of engaging with the part to be engaged of said mounting member is formed at either upper or lower end of an open end where the engagement part on each side plate of said ice making member is formed.

7. The ice making section of the stream down type ice making machine according to claim 6, wherein a regulation part incapable of being engaged with the engagement part of said ice making member is formed at either lower end or upper end of an end edge where the part to be engaged of said mounting member is formed.

8. An ice making section of the stream down type ice making machine which comprises a pair of ice making plates and an evaporation pipe laid meanderingly between back surfaces of the two ice making plates, a coolant being circulatingly supplied therethrough, for making an ice block by supplying ice making water which streams down onto a surface of each ice making plate cooled by supplying the coolant through the evaporation pipe circulatingly, wherein:

said pair of ice making plates are assembled so as to be attachable to and detachable from each other through an assembling means so that the back surfaces thereof are in contact with said evaporation pipe; and said assembling means comprises:

a plurality of pieces to be engaged being elastic which are arranged between the linear parts of said evaporation pipe extending in a transverse direction being separated above and below on the back surface of either of said ice making plates; and a plurality of engagement piece being elastic arranged at a position corresponding to each of said pieces to be engaged on the back surface of the other of said ice making plates, for engaging with the piece to be engaged, wherein:

when holding said evaporation pipe between said two ice making plates by engaging each of said engagement pieces with each of the corresponding pieces to be engaged, said engagement piece and piece to be engaged are elastically deformed and the elastic force works to bring the back surface of each ice making plate into close contact with the evaporation pipe.

* * * * *